US008466381B2

(12) United States Patent
Galpchian

(10) Patent No.: US 8,466,381 B2
(45) Date of Patent: Jun. 18, 2013

(54) PUSH BUTTON SLIDER SWITCH

(75) Inventor: Levon Galpchian, Cranston, RI (US)

(73) Assignee: Tower Manufacturing Corporation, Providence, RI (US)

( * ) Notice: Subject to any disclaimer, the term of this patent is extended or adjusted under 35 U.S.C. 154(b) by 326 days.

(21) Appl. No.: 12/930,667

(22) Filed: Jan. 13, 2011

(65) Prior Publication Data

US 2012/0181159 A1 Jul. 19, 2012

(51) Int. Cl.
*H01H 13/76* (2006.01)

(52) U.S. Cl.
USPC ..... 200/5 E

(58) Field of Classification Search
USPC ..... 200/536, 5 E
IPC ..... H01H 13/72
See application file for complete search history.

(56) References Cited

U.S. PATENT DOCUMENTS

| | | | |
|---|---|---|---|
| 2,431,904 | A | 12/1947 | Andrews |
| 2,968,704 | A | 1/1961 | Woodward et al. |
| 3,678,288 | A | 7/1972 | Swanke et al. |
| 4,362,912 | A | 12/1982 | Woodward |
| 5,315,076 | A | 5/1994 | Renkes et al. |
| 6,118,085 | A | 9/2000 | Chu |

*Primary Examiner* — Vanessa Girardi
(74) *Attorney, Agent, or Firm* — Kriegsman & Kriegsman

(57) ABSTRACT

A push button switch includes a hollowed housing, an electric switching circuit coupled to the hollowed housing and a stack of non-conductive sliders disposed within a narrow recess in the housing. An array of externally accessible push rods extends vertically through the housing and is used to longitudinally displace certain sliders into selective engagement with movable contacts in the electric switching circuit. A plurality of outwardly protruding projections are formed on at least one of the front and rear surfaces of alternating sliders, each projection being generally circular in transverse in cross-section and in the range of approximately 0.001 inches to 0.004 inches in height. The entire surface contact established between adjacent sliders is achieved through the one or more projections, thereby reducing the frictional forces experienced within the stack during slider displacement.

19 Claims, 17 Drawing Sheets

PUSH BUTTON SLIDER SWITCH

BACKGROUND OF THE INVENTION

The present invention relates generally electrical switches and more particularly to push button switches that include a plurality of stacked non-conductive sliders.

A push button switch is a type of electrical switch that is used to regulate the flow of current from a power source to a load through the depression of one or more buttons. Due to their relatively durable and inexpensive construction, push button switches are commonly utilized as manually operable controls for a wide variety of household electrical appliances, such as food processors, blenders, air conditioners, electric ranges and washing machines.

One type of push button switch which is known in the art includes an elongated, rectangular housing constructed of a rigid non-conductive material, switch means mounted within the housing, a plurality of externally accessible push rods extending through the housing and a plurality of stacked, non-conductive sliders movably mounted within the housing.

The switch means connects a power source to the designated load (i.e., the appliance in which the switch is installed). The switch means includes a plurality of cantilever spring blade contacts that are movable between open and closed positions, the closure of each spring blade contact serving to control a corresponding operational setting for the load (e.g., a specific motor speed).

The plurality of push rods extend vertically through the top surface of the housing in a substantially parallel relationship. Each push rod includes an enlarged, rounded first end that terminates in the housing and a second end that terminates outside of the housing, the second end being adapted to permanently receive a finger-sized actuation button.

The plurality of sliders are longitudinally arranged within a corresponding recess in the housing in a front-to-back stacked relationship. Each elongated slider is constructed of an insulating material, such as plastic, and includes flattened front and rear surfaces. The bottom edge of each slider is provided with a plurality of narrow, equidistantly spaced projections, or tines, as well as a unique arrangement of raised cam surfaces formed between selected projections, each raised cam surface being dimensioned to selectively engage and pivot a corresponding spring blade contact from its closed position to its open position. Similarly, the top edge of each slider is provided with a plurality of equidistantly spaced projections as well as a unique arrangement of inclined surfaces formed between selected projections. As will be described further below, each inclined surface is positioned and dimensioned to interact with the innermost end of a corresponding push rod which, in turn, causes the slider to displace longitudinally within the housing recess.

Accordingly, in use, the depression of an actuation button serves to vertically displace its corresponding push rod deeper into the interior cavity of the housing. Based on the configuration of the top edge of the plurality of stacked sliders, the displacement of the selected push rod causes its inner end to ultimately engage the inclined surface of one or more sliders which, in turn, causes the sliders to longitudinally travel within the recess in the housing. In this capacity, it is to be understood that the pattern of cams and inclined surfaces on the stack of sliders results in the closure of at least one spring blade contact in response to the depression of a corresponding actuation button, which is highly desirable.

Examples of pushbutton switches of the type described in detail above are disclosed in U.S. Pat. No. 6,118,085 to R. Chu, U.S. Pat. No. 5,315,076 to K. Renkes et al., U.S. Pat. No. 4,362,912 to S. Woodward, U.S. Pat. No. 3,678,288 to R. Swanke et al., and U.S. Pat. No. 2,968,704 to S. Woodward et al., all of the aforementioned patents being incorporated herein by reference.

Pushbutton switches of the type described above suffer from a notable drawback. Specifically, as noted above, the plurality of non-conductive sliders are typically arranged in a stack with the front and rear surfaces of adjacent sliders lying flush against one another. Accordingly, as a slider is displaced longitudinally within the housing, its front and rear surfaces remain in constant contact with its adjacent sliders. Due to the considerable surface area of the front and rear surfaces of each slider, considerable frictional forces are created between the moving slider and its adjacent sliders during the displacement process which, in turn, can render button depression rather difficult.

In response to the aforementioned shortcoming, it is known in the art for lubricants to be used in pushbutton switches to reduce frictional forces. However, it has been found that lubricants tend to break down over time and collect between adjacent sliders, thereby further increasing the frictional force experienced between sliders, which is highly undesirable.

SUMMARY OF THE INVENTION

It is an object of the present invention to provide a new and improved push button switch.

It another object of the present invention to provide a push button switch that includes a plurality of stacked non-conductive sliders.

It is yet another object of the present invention to provide a push button switch of the type as described above experiences limited frictional forces between adjacent sliders.

It is still another object of the present invention to provide a push button switch of the type as described above that is durable, has a limited number of parts, is inexpensive to manufacture and is easy to use.

Accordingly, there is provided a push button switch for regulating the application of current from a power source to a load, the push button switch comprising (a) a hollowed housing, (b) an electric switching circuit coupled to the hollowed housing, the electric switching circuit comprising a movable contact for regulating the application of current from the power source to the load, and (c) first and second sliders, each of the first and second sliders including a front surface and a rear surface, the first and second sliders being arranged in a front-to-back stacked relationship and disposed within the housing, at least one of the first and second sliders being adapted for longitudinal displacement within the housing and into selective engagement with the movable contact, (d) wherein at least one of the first and second sliders includes one or more projections formed on at least one of its front and rear surfaces, the entire surface contact established between the first and second sliders being achieved through the one or more projections.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
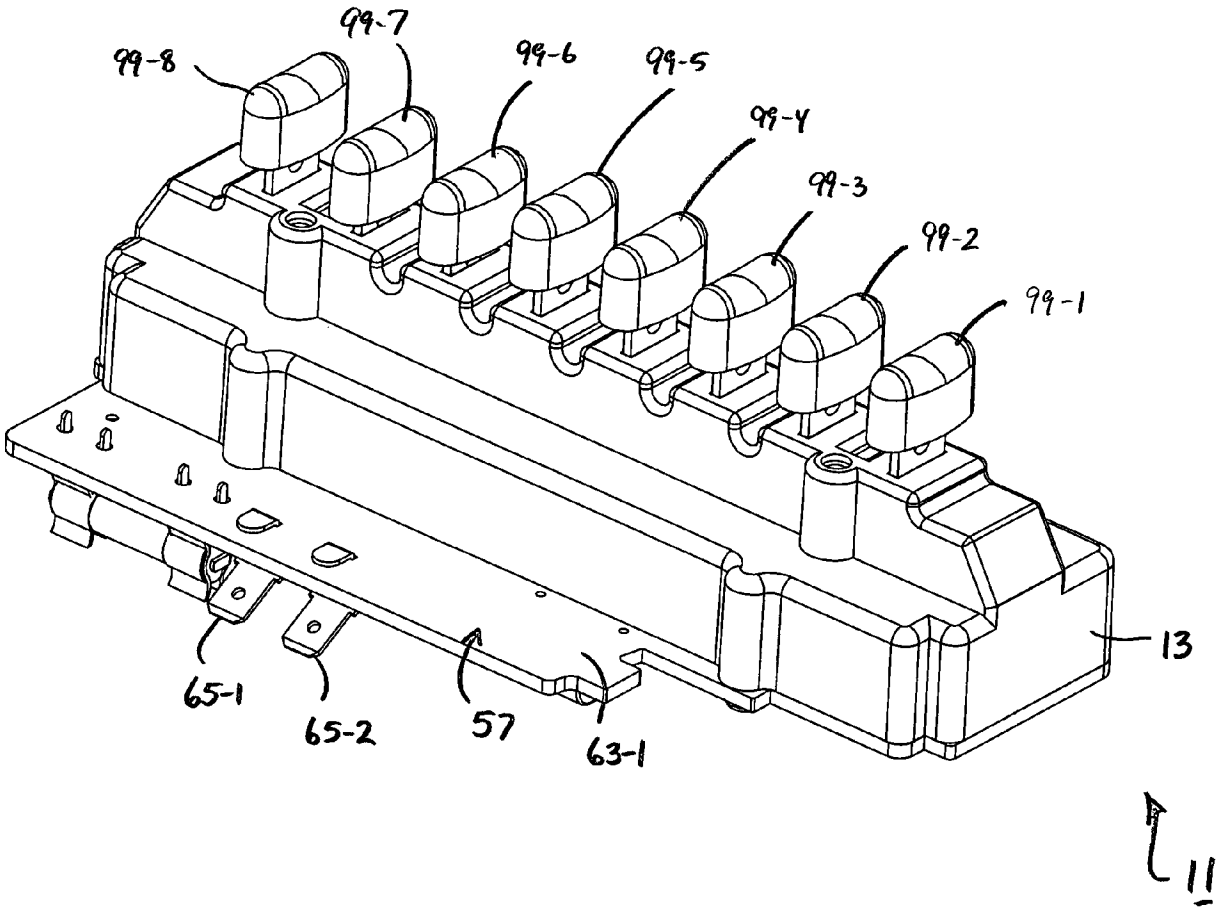
FIG. 1 is a top perspective view of a push button switch constructed according to the teachings of the present invention.
Figure 2:
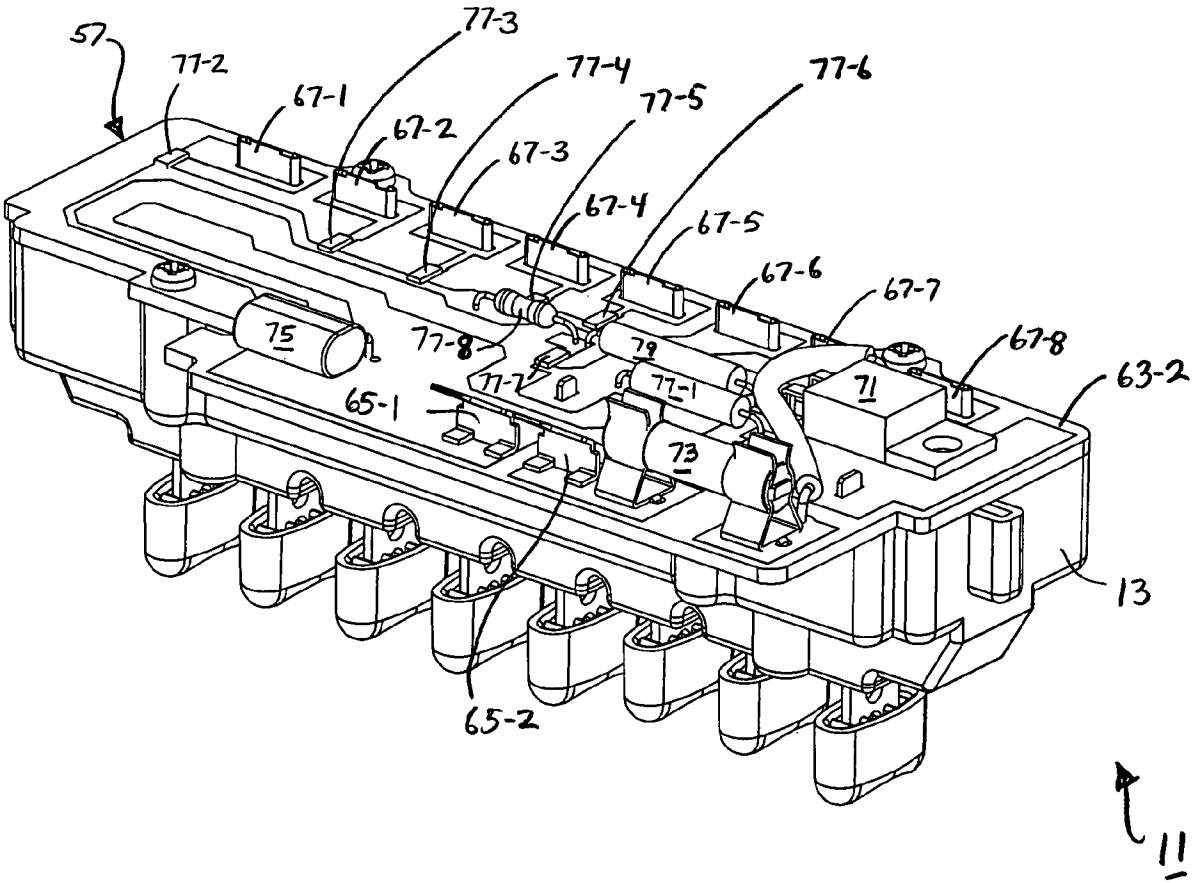
FIG. 2 is a bottom perspective view of the push button switch shown in FIG. 1.
Figure 3:
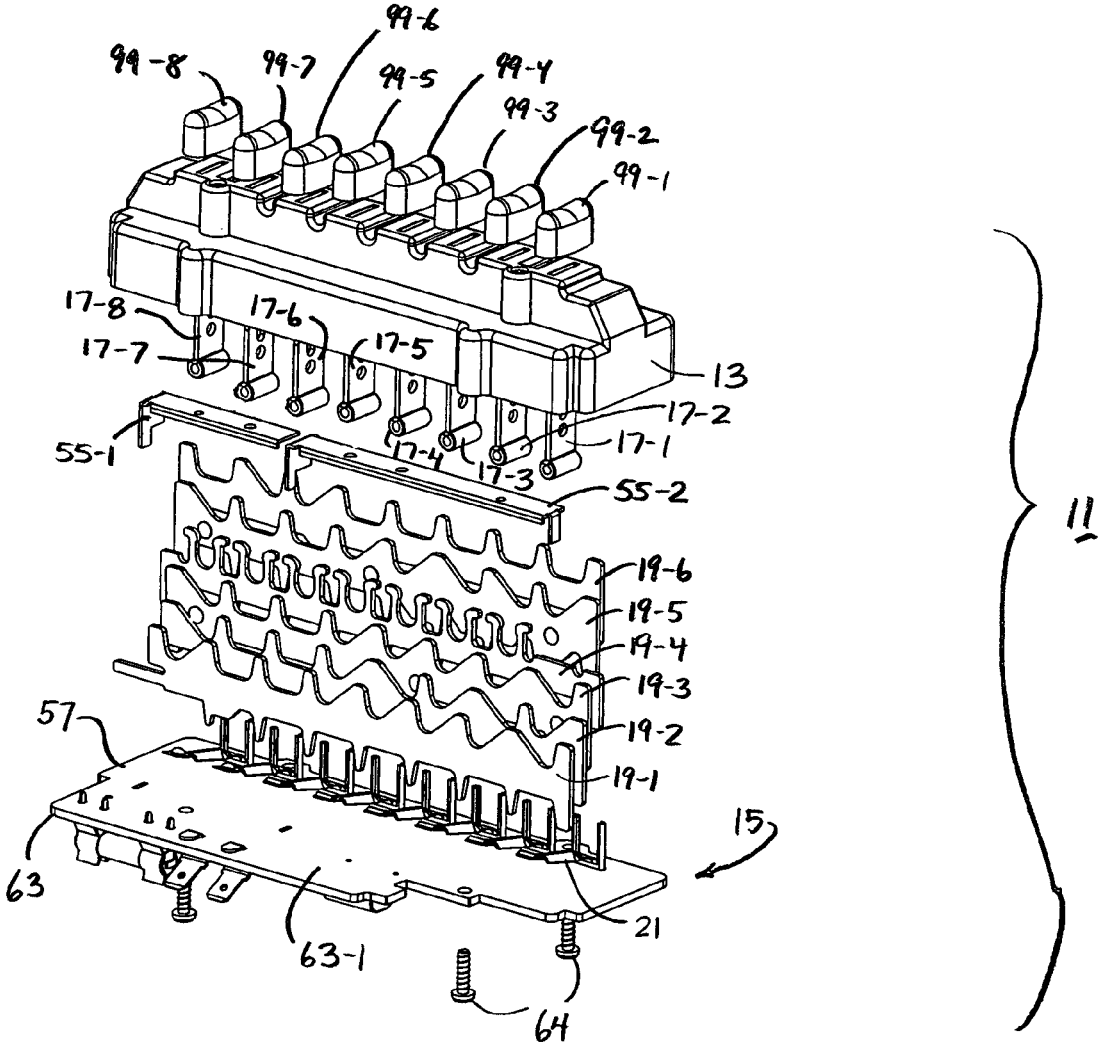
FIG. 3 is an exploded, top perspective view of the push button switch shown in FIG. 1.

Referring now to FIGS. 1-3, there are shown top perspective, bottom perspective and top, exploded perspective views, respectively, of a push button switch constructed according to the teachings of the present invention, the push button switch being identified generally herein by reference numeral 11. As will be described further in detail below, push button switch 11 is designed to regulate the flow of current from a power source to a designated load, such as a motor. In this capacity, push button switch 11 can be used, inter alia, to provide a plurality of operational settings for a wide variety of household electrical appliances, such as food processors, blenders, air conditioners, electric ranges, washing machines and the like.

As seen most clearly in FIG. 3, push button switch 11 comprises a hollowed switch housing 13, an electric switching circuit 15 at least partially disposed within housing 13, a plurality of externally accessible push rods 17-1 thru 17-8 extending through housing 13 and a plurality of stacked, non-conductive sliders 19-1 thru 19-6 longitudinally disposed within housing 13. As will be described further in detail below, electrical circuit 15 is designed to include a plurality of movable contacts 21 that operate as switches for regulating the flow of current from the power source to the load. In use, the depression of selected push rods 17 serves to longitudinally displace corresponding sliders 19 within housing 13 and into selective engagement with associated contacts 21. In this manner, the state of the various switches of electric circuit 15 can be regulated through the depression of push rods 17.

Figure 4B:
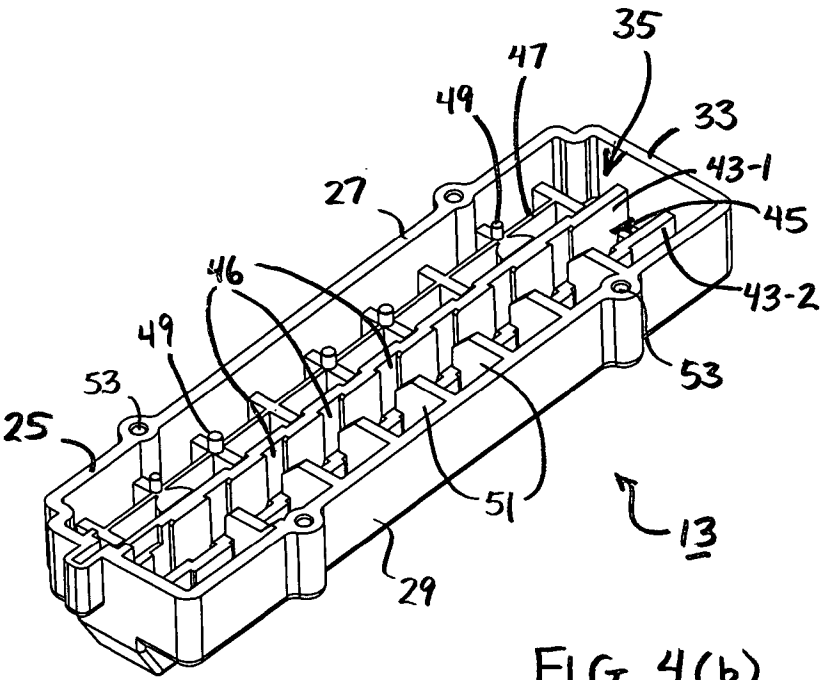
FIGS. 4(*a*) and 4(*b*) are top perspective and bottom perspective views, respectively, of the housing shown in FIG. 3.
Figure 4A:
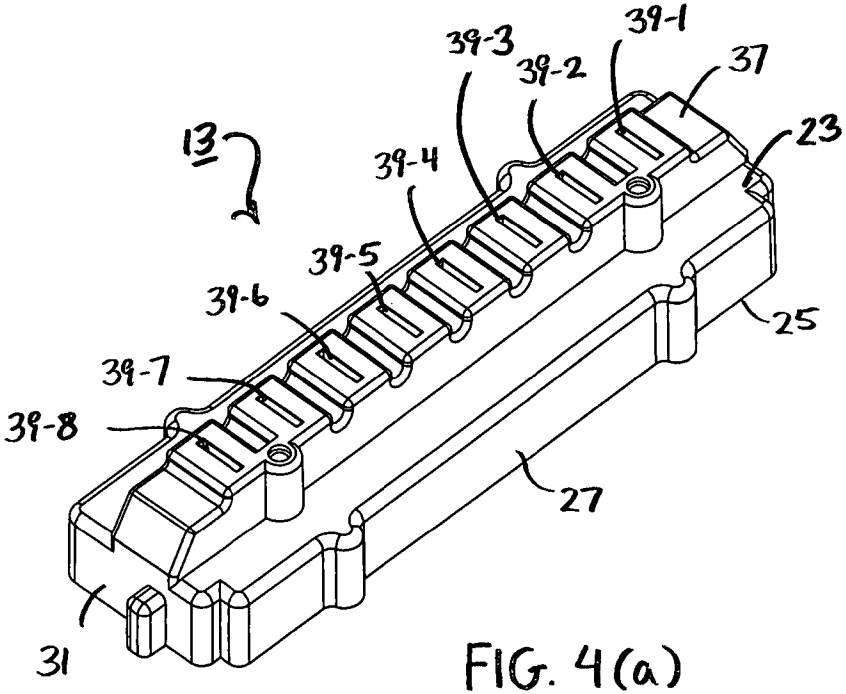

Referring now to FIGS. 4(*a*) and 4(*b*), housing 13 is a unitary, generally rectangular member constructed of a rigid, durable and non-conductive material, such as plastic. Housing 13 includes a top wall 23, a bottom wall 25, a front wall 27, a rear wall 29, a left end wall 31 and a right end wall 33 that together define an interior cavity 35 that is largely accessible through open bottom wall 25.

As seen most clearly in FIG. 4(*a*), a raised longitudinal projection 37 generally rectangular in transverse cross-section is formed on and extends orthogonally out from top surface 23. Projection 37 is shaped to define a plurality of transversely extending, equidistantly spaced, rectangular slots 39-1 thru 39-8 that extend down and into communication with interior cavity 35. As will be described further below, each slot 39 is dimensioned to fittingly receive a corresponding push rod 17, thereby providing pushbutton switch 11 with externally accessible means for regulating the switching state of movable contacts 21 (i.e., through the depression of push rods 17).

As seen most clearly in FIG. 4(*b*), housing 13 also includes a pair of parallel inner walls 43-1 and 43-2 that together define a narrow recess 45 that is dimensioned to fittingly receive the plurality of stacked sliders 19, inner walls 43-1 and 43-2 being shaped to define complementary pairs of opposing U-shaped notches 46 that serve as guide channels for limiting push rods 17 to vertical displacement, as will be described further below.

Housing 13 additionally includes an elongated longitudinal rib 47 formed in interior cavity 35 along front wall 27 in a spaced apart, parallel relationship relative thereto, rib 47 comprising a plurality of cylindrical mounting posts, or rivets, 49. As will be described further below, rib 47 serves as a support on which a pair of contact plates for electric circuit 15 is mounted.

Housing 13 further includes a plurality of parallel partitions 51 formed in interior cavity 35 along rear wall 29 in a transverse relationship relative thereto. Partitions 51 serve, among other things, to electrically insulate the fixed ends of adjacent movable contacts 21. Lastly, a plurality of cylindrical mounting bores 53 are formed into bottom wall 25 that facilitate the assembly of switch 11.

Referring back to FIG. 3, switching circuit 15 includes a first contact plate 55-1, a second contact plate 55-2 as well as a printed circuit board assembly 57. As can be appreciated, one end of each contact plate 55 is conductively connected to printed circuit board assembly 57 to form the complete electric circuit 15.

Figure 5:
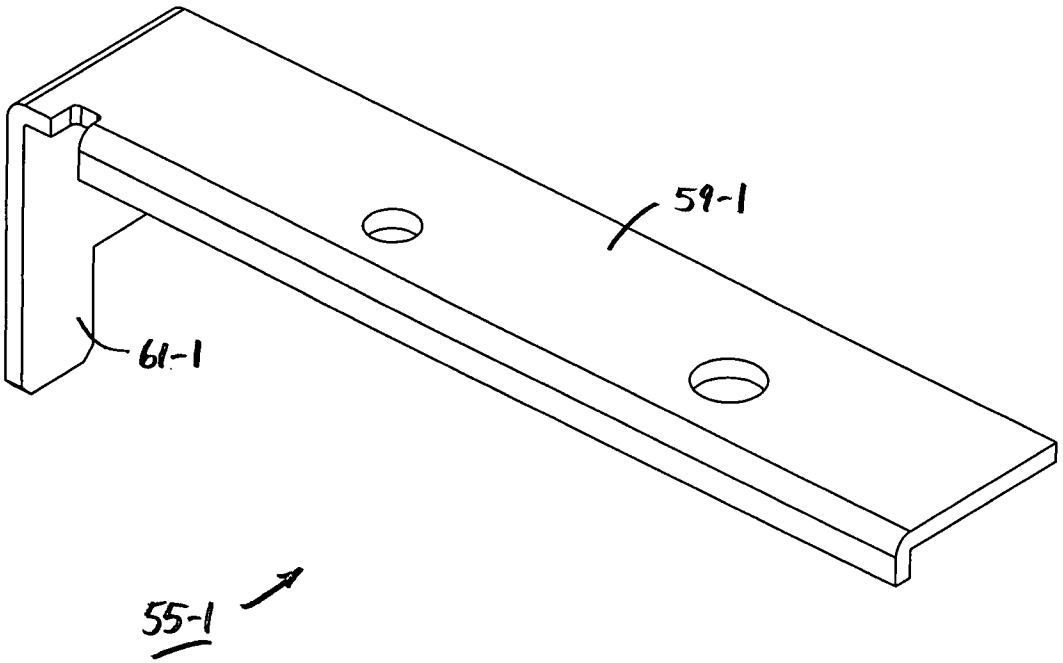
FIG. 5 is an enlarged, top perspective view of the first contact plate shown in FIG. 3.

First contact, or bus, plate 55-1, which is shown in isolation in FIG. 5, is constructed of a highly conductive material, such as brass or copper, and includes a shortened, flattened, rigid blade 59-1 and an orthogonally extending contact tab 61-1 that is dimensioned for conductive thru-hole mounting onto printed circuit board assembly 57.

Figure 6:
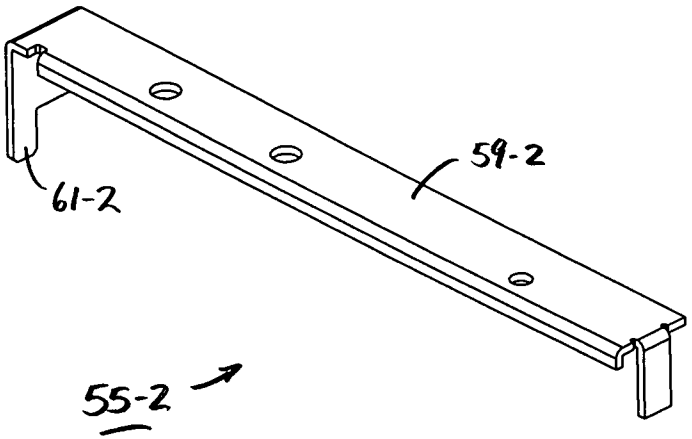
FIG. 6 is an enlarged, top perspective view of the second contact plate shown in FIG. 3.

Similarly, second contact, or bus, plate 55-2, which is shown in isolation in FIG. 6, is constructed of a highly conductive material, such as brass or copper, and includes an elongated, flattened, rigid blade 59-2 and an orthogonally extending contact tab 61-2 that is dimensioned for conductive thru-hole mounting onto printed circuit board assembly 57.

Together, contact plates 55-1 and 55-2 are mounted in-line and end-to-end on longitudinal rib 47 in a spaced apart relationship and are retained securely thereon by posts 49, with each post 49 fittingly projecting through a corresponding circular opening formed in blades 59. As will be described further below, contact plate 55-1 serves as a first conductive path through which current is delivered from the power source to the load and contact plate 55-2 serves as a second sequential conductive path through which current is delivered from the power source to the load.

Figure 7:
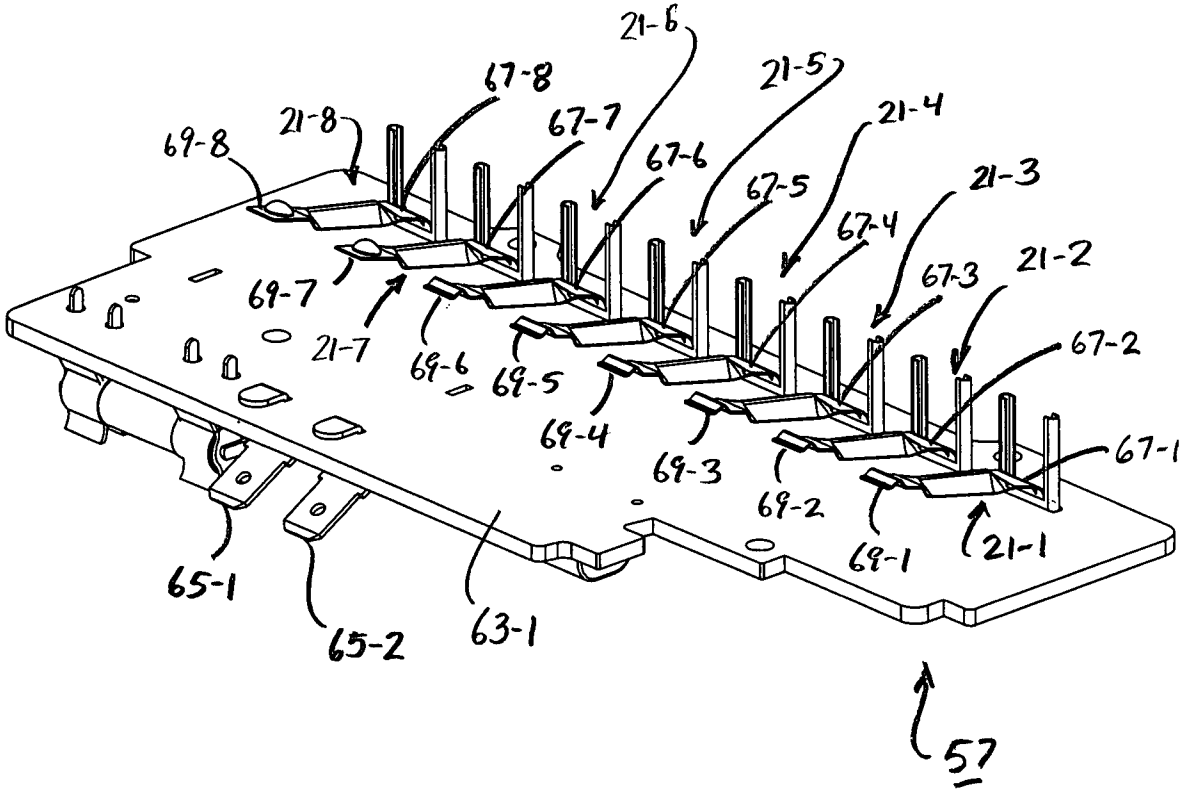
FIG. 7 is a top perspective view of the printed circuit board assembly shown in FIG. 3.

Referring now to FIGS. 2, 3 and 7, printed circuit board assembly 57 comprises a single-sided printed circuit board (PCB) 63 that includes a non-conductive top surface 63-1 and a conductively etched bottom surface 63-2. PCB 63 is mounted onto housing 13 with its top surface 63-1 disposed flush against bottom wall 25 of housing 13. A plurality of screws 64 are disposed through holes in PCB 63 and into threaded engagement with bores 53 to releasably secure PCB 63 to housing 13.

A pair of contact tabs 65-1 and 65-2 are conductively mounted onto bottom surface 63-2 of PCB 63, with contact tab 65-1 serving as the line terminal for circuit 15 (i.e., designated for connection to the power source) and contact tab 65-2 serving as the load terminal for circuit 15 (i.e., designated for connection to the load).

Printed circuit board assembly 57 also includes movable contacts 21-1 thru 21-8 that are conductively thru-hole mounted onto top surface 63-1 of PCB 63 in a substantially linear array. Schematically, movable contacts 21 are located between line terminal 65-1 and load terminal 65-2 and are designed to selectively contact bus plates 55 to regulate the flow of current from the power source to the load, as will be explained further below.

As seen most clearly in FIG. 7, each movable contact 21 is preferably formed as a unitary conductive member that includes a fixed first end 67 and a pivotable second end 69. Specifically, first end 67 is fixedly thru-hole mounted onto PCB 63 and includes a pair of upwardly extending C-shaped alignment arms that are dimensioned to protrude between a corresponding pair of partitions 53 in housing 13. Second end 69 is in the form of cantilevered spring blade, or finger, that is naturally biased to contact one of bus plates 55 at its free end. However, it should be noted that the spring-based construction of second end 69 of each contact 21 allows for its separation from its corresponding bus plate 55 upon receiving a suitable downward force thereon.

Referring back to FIG. 2, printed circuit board assembly 57 additionally includes a Triode for Alternating Current (TRIAC) 71, a fuse 73, a capacitor 75 and a plurality of resistors 77 that are all conductively mounted onto bottom surface 63-2. TRIAC 71 functions as a bi-directional diode in electric circuit 15 and serves as the principal switching device for regulating the flow of current from the power source to the load. TRIAC 71 is represented herein as preferably being in the form a 600 volt, 10 mA device constructed in a 3-pin package.

It should be noted that TRIAC 71 is preferably surface mounted onto bottom surface 63-2 of PCB 63 using a conductive adhesive mixture of glue and solder paste. Through the application of heat (e.g., by running PCB assembly 57 through an oven), the conductive adhesive mixture flows and subsequently hardens to surface mount TRIAC 71 onto bottom surface 63-2 of PCB 63. As can be appreciated, the aforementioned mounting process utilizes considerably less solder than traditional thru-hole, hand-soldering techniques and is thereby significantly reduces manufacturing costs, which is highly desirable.

Figure 8:
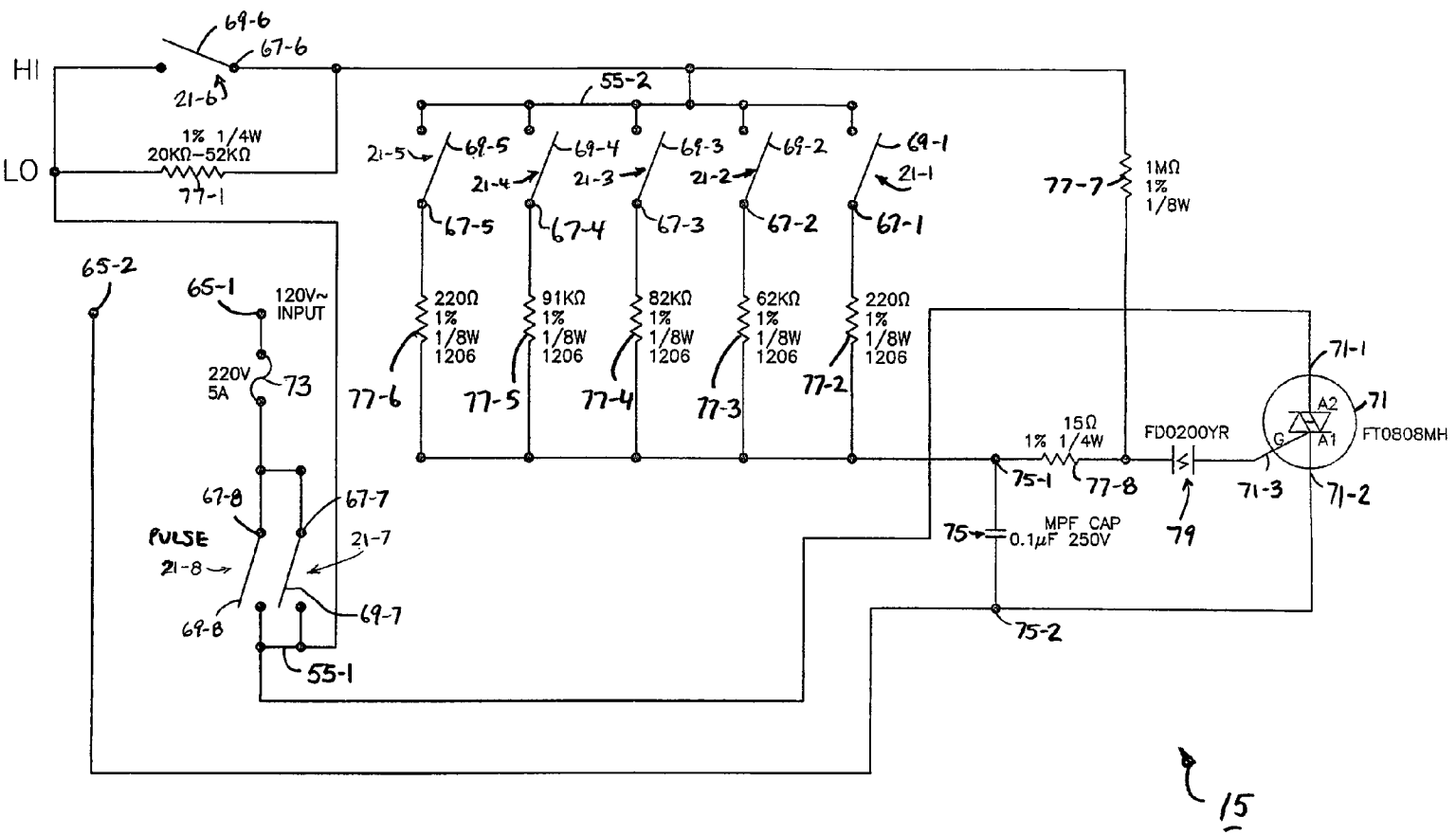
FIG. 8 is a schematic representation of the electric switching circuit created using the contact plates and printed circuit board assembly shown in FIG. 3.

Referring now to FIG. 8, there is shown a schematic representation of electric circuit 15. As can be appreciated, the design of electric circuit 15 enables push button switch 11 to be used to vary the flow of current flow from the power source to the load amongst ten distinct values. In this capacity, push button switch 11 could be used, inter alia, to provide ten different motor speed settings for an electric appliance.

As can be seen, line terminal 65-1 is connected to fixed first ends 67-7 and 67-8 of movable contacts 21-7 and 21-8, respectively, by fuse 73 (which is preferably of the 220 volt, 5 A variety). The pivotable second ends 69-6, 69-7 and 69-8 of movable contacts 21-6, 21-7 and 21-8, respectively, are naturally biased to contact primary bus plate 55-1. A matching resistor 77-1, preferably in the range of approximately 20 kohms-52 kohms, is connected in parallel with movable contact 21-6 to provide both HI and LO primary current settings. In this capacity, movable contacts 21-6, 21-7 and 21-8 can be used herein as switching devices that initially regulate the flow of current from line terminal 65-1 amongst OFF/PULSE, LO and HI type settings.

Furthermore, pivotable second ends 69-1, 69-2, 69-3, 69-4 and 69-5 of movable contacts 21-1, 21-2, 21-3, 21-4 and 25-5, respectively, are naturally biased to contact secondary bus plate 55-2. In addition, fixed end 67-6 of movable contact 21-6 is connected to bus plate 55-2.

Fixed first ends 67-1, 67-2, 67-3, 67-4 and 67-5 of movable contacts 21-1, 21-2, 21-3, 21-4 and 21-5, respectively, are connected to a first terminal 75-1 of capacitor 75 through a plurality of corresponding parallel resistors 77-2, 77-3, 77-4, 77-5 and 77-6, respectively, of varying resistance, with second terminal 75-2 of capacitor 75 being connected to load terminal 65-2. In this manner, the closure of each of movable contacts 21-1 thru 21-6 serves to further regulate the current flow to load terminal 65-2 amongst values.

The input terminal 71-1 for TRIAC 71 is connected to primary bus plate 51-1, the output terminal 71-2 for TRIAC 71 is connected to load terminal 65-2 and the gate terminal 71-3 for TRIAC 71 is connected to a triggering diode 79. The free terminal of triggering diode 79 is in turn connected to first terminal 75-1 of capacitor 75 through a resistor 77-8.

In this manner, by combining the primary HI and LO settings obtained through the closure of contacts 21-6 and 21-7, respectively, with the closure of each of the five operational contacts 22-1 thru 22-5, a total of ten distinct current values can be created to trigger TRIAC 71 in such a manner so as to regulate the variable current provided to load terminal 65-2. In the absence of the closure of one of contacts 21-6 and 21-7 in combination with the closure of one of contacts 21-1 thru 21-5, TRIAC 71 prevents the passage of current from line terminal 65-1 to load terminal 65-2. As referenced briefly above and as will be described further in detail below, sliders 19 are specifically designed to selectively engage and open second end 69 of movable contacts 21 to create the ten aforementioned operational settings.

Figure 9A:
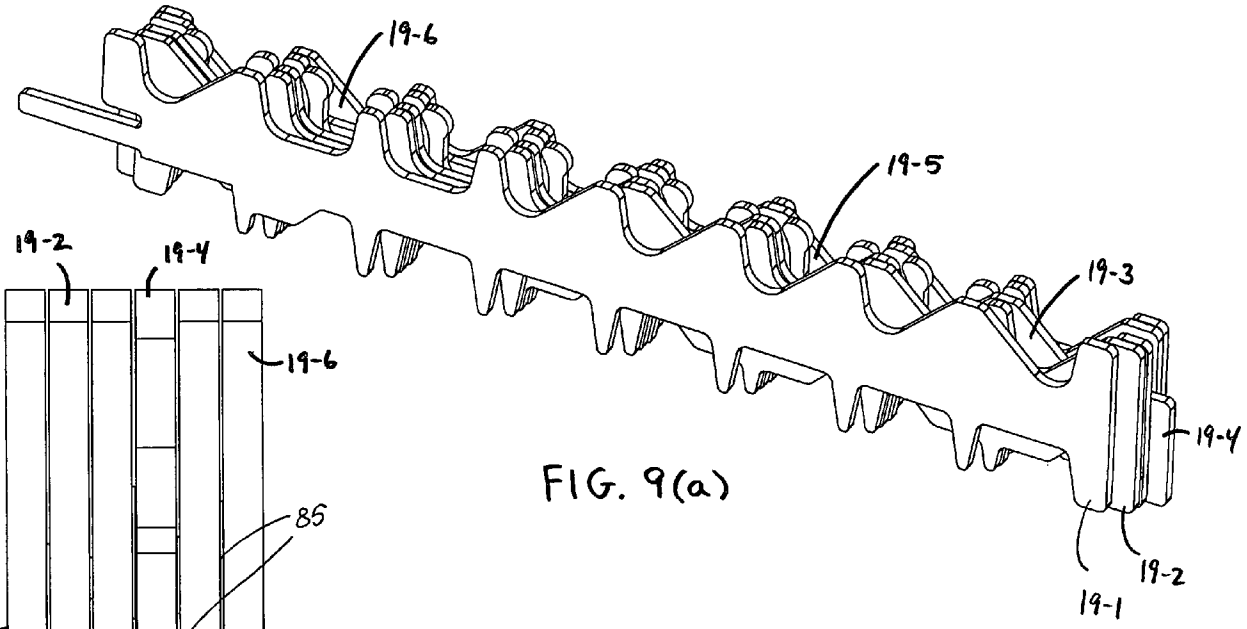
FIGS. 9(*a*) and 9(*b*) are front and right end views, respectively, of the plurality of sliders shown in FIG. 3.
Figure 9B:
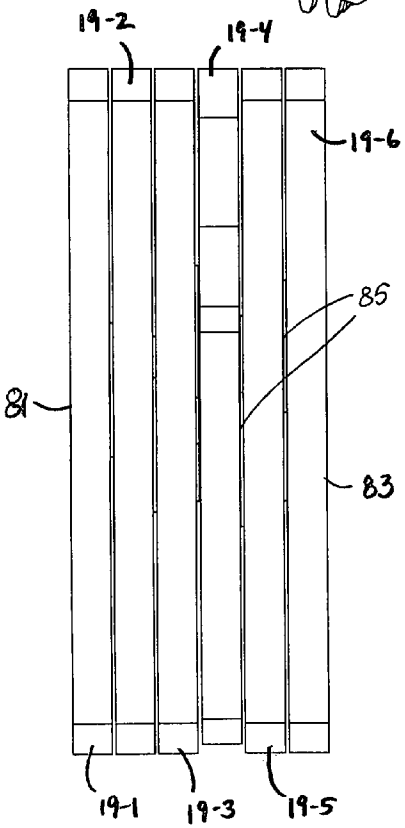
Figure 10C:
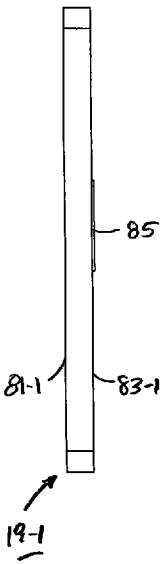
FIGS. 10(*a*)-(*c*) are front perspective, rear perspective and right end views, respectively, of the first slider shown in FIG. 9(*a*)
Figure 10A:
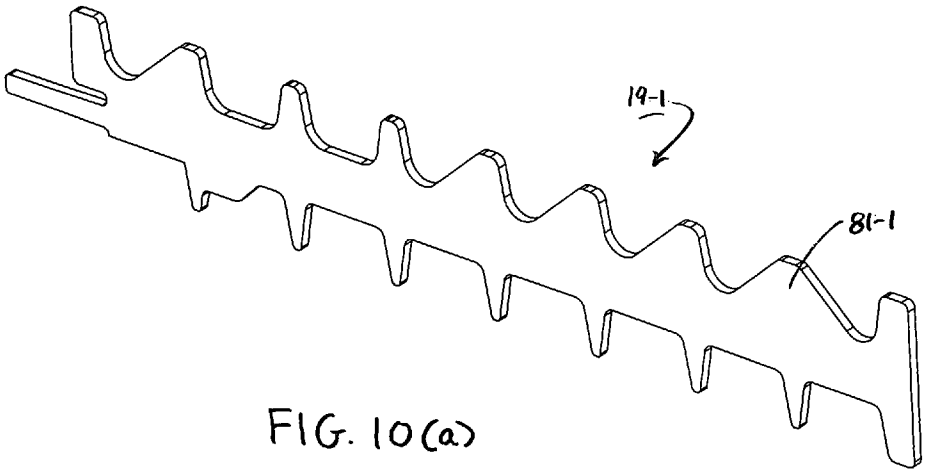
Figure 10B:
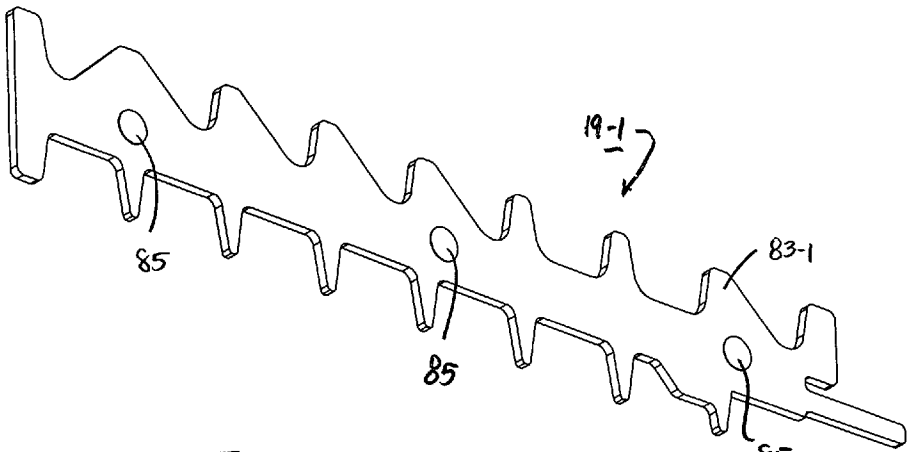
Figure 11A:
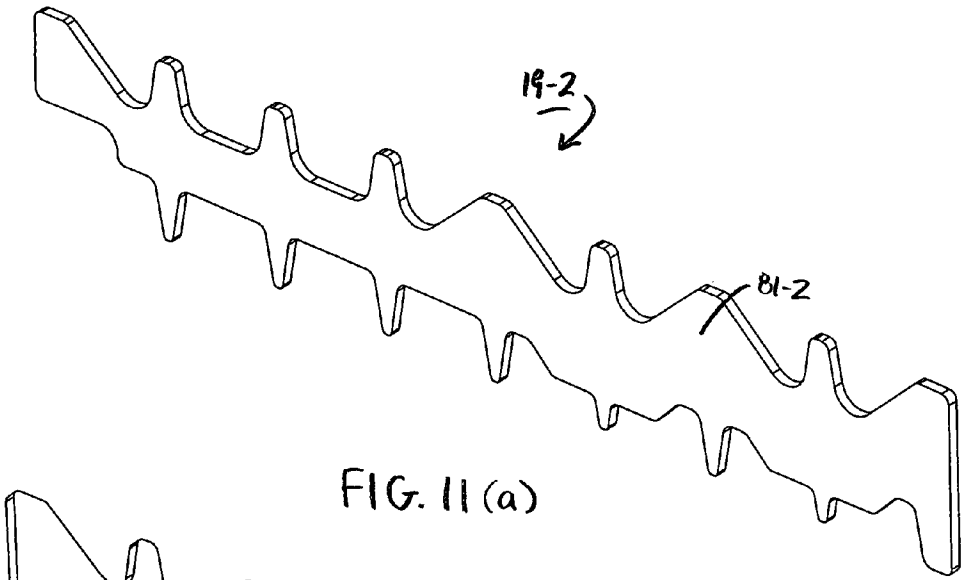
FIGS. 11(*a*)-(*c*) are front perspective, rear perspective and right end views, respectively, of the second slider shown in FIG. 9(*a*)
Figure 11B:
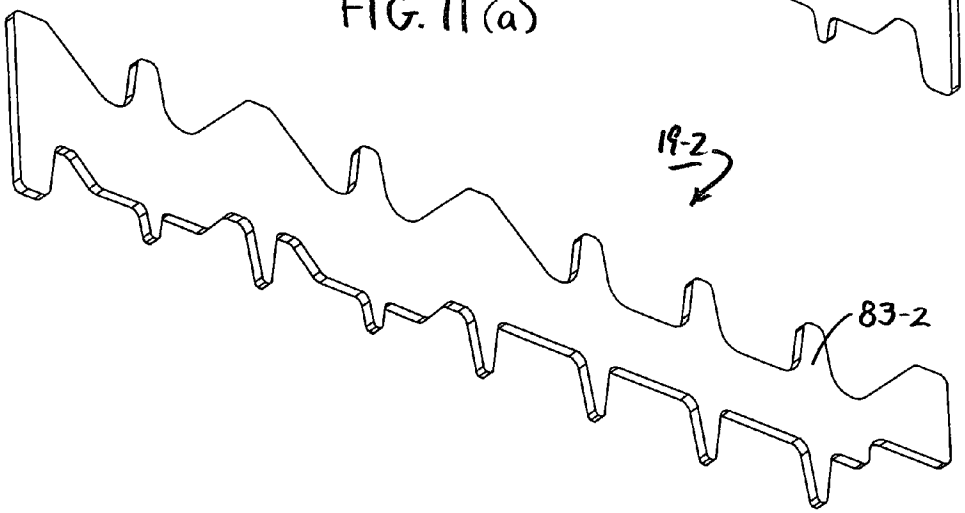
Figure 11C:
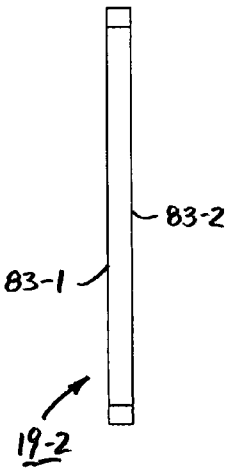
Figure 12C:
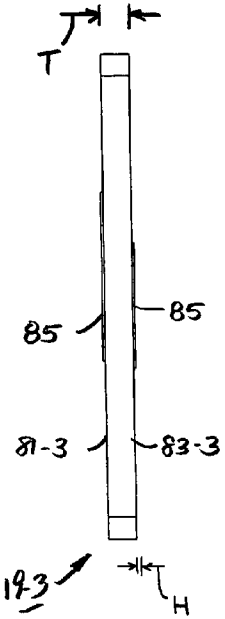
FIGS. 12(*a*)-(*c*) are front perspective, rear perspective and right end views, respectively, of the third slider shown in FIG. 9(*a*)
Figure 12A:
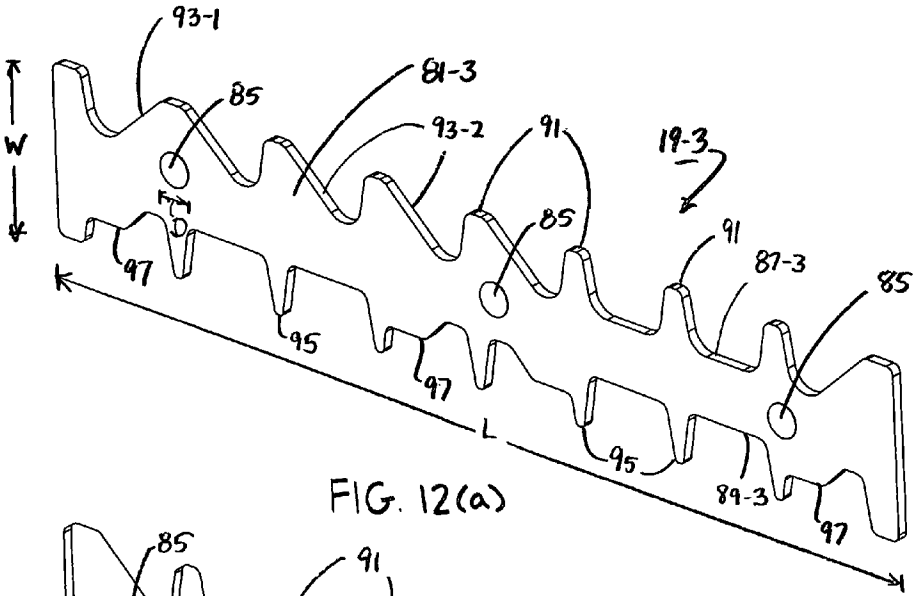
Figure 12B:
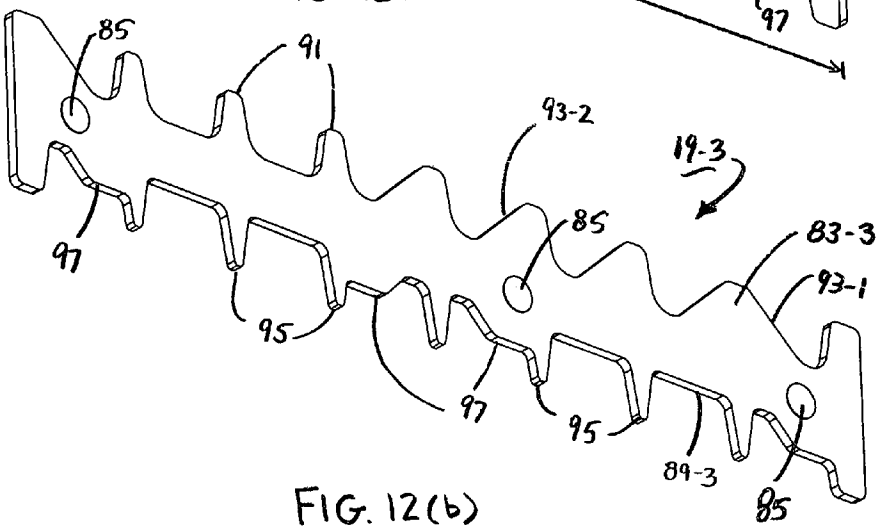
Figure 13C:
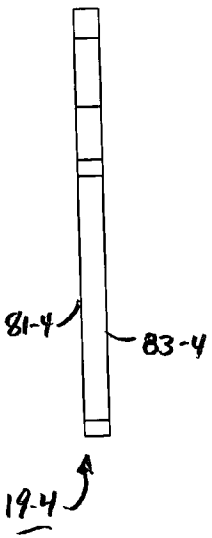
FIGS. 13(*a*)-(*c*) are front perspective, rear perspective and right end views, respectively, of the fourth slider shown in FIG. 9(*a*)
Figure 13A:
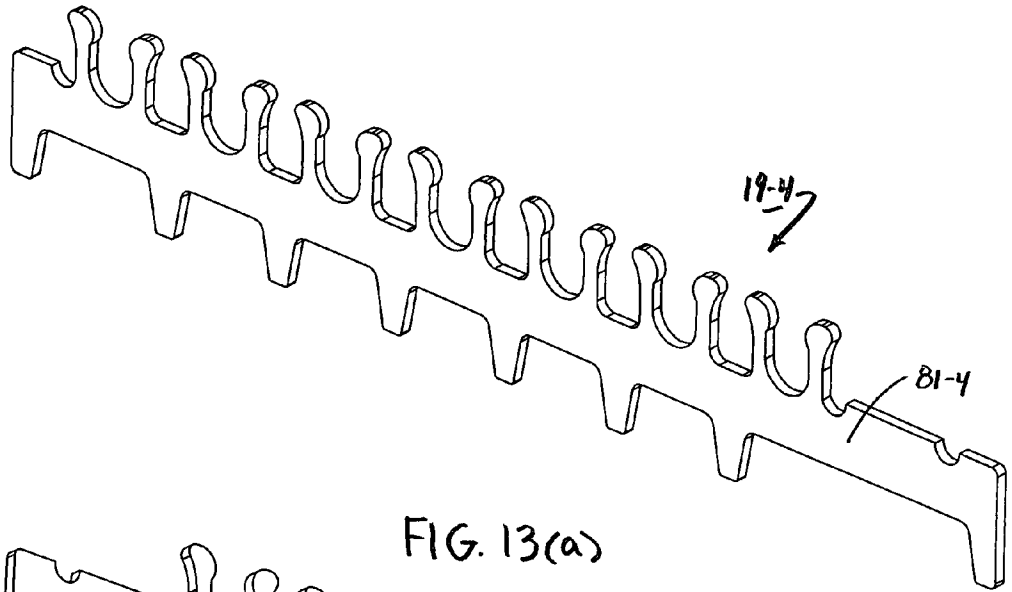
Figure 13B:
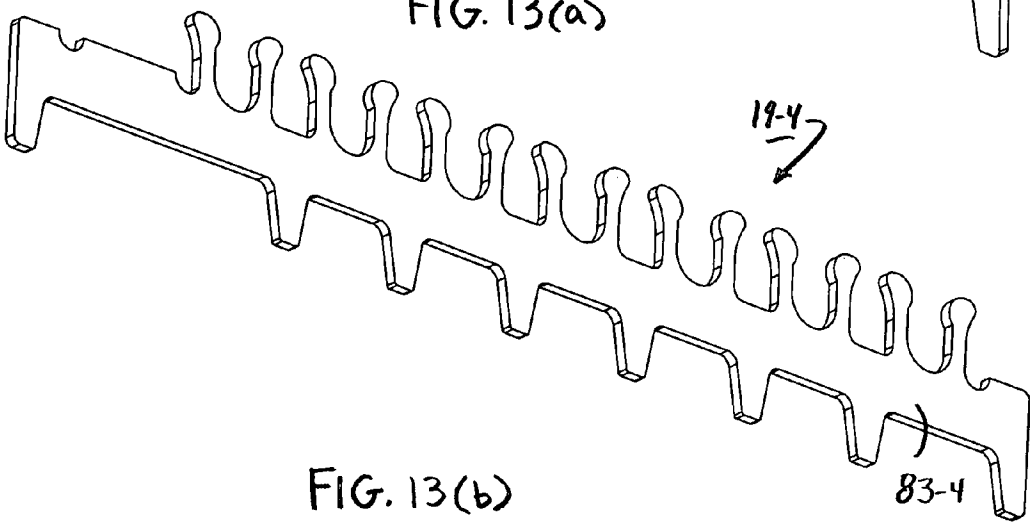

Referring now to FIGS. 3, 9(*a*) and 9(*b*), first slider 19-1 (which is shown in isolation in FIGS. 10(*a*)-(*c*)), second slider 19-2 (which is shown in isolation in FIGS. 11(*a*)-(*c*)), third slider 19-3 (which is shown in isolation in FIGS. 12(*a*)-(*c*)), fourth slider 19-4 (which is shown in isolation in FIGS. 13(*a*)-

Figure 14C:
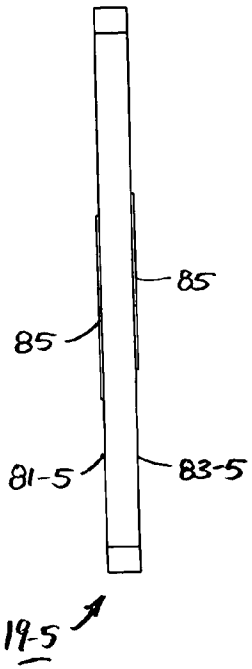
FIGS. 14(*a*)-(*c*) are front perspective, rear perspective and right end views, respectively, of the fifth slider shown in FIG. 9(*a*)
Figure 14A:
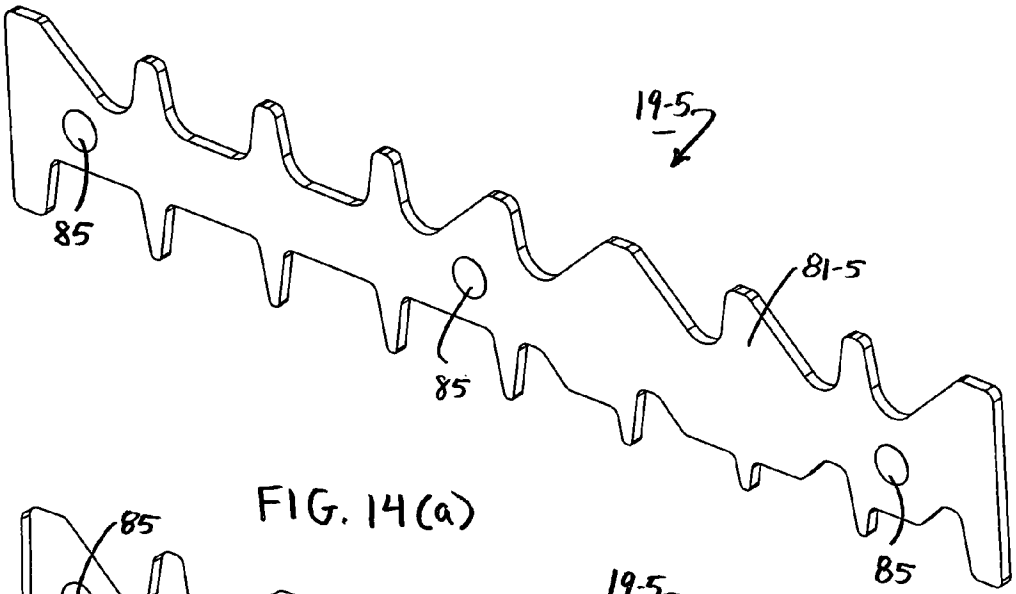
Figure 14B:
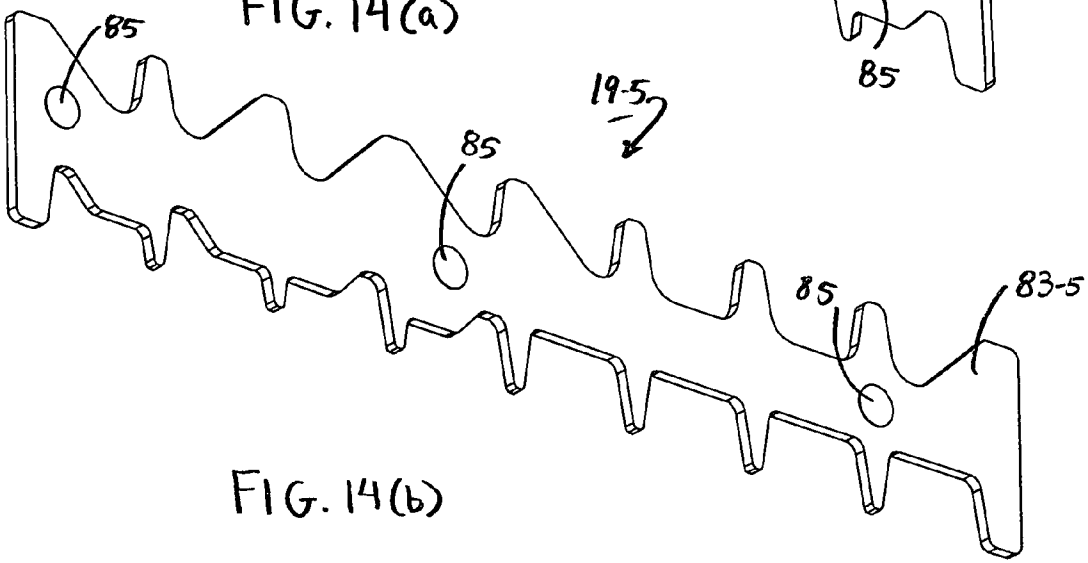
Figure 15A:
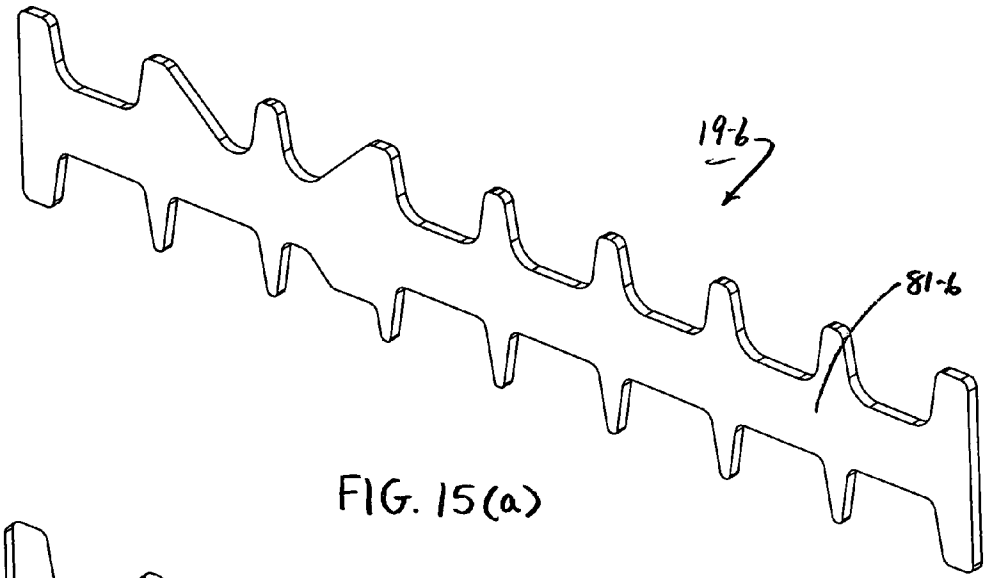
FIGS. 15(*a*)-(*c*) are front perspective, rear perspective and right end views, respectively, of the sixth slider shown in FIG. 9(*a*)
Figure 15B:
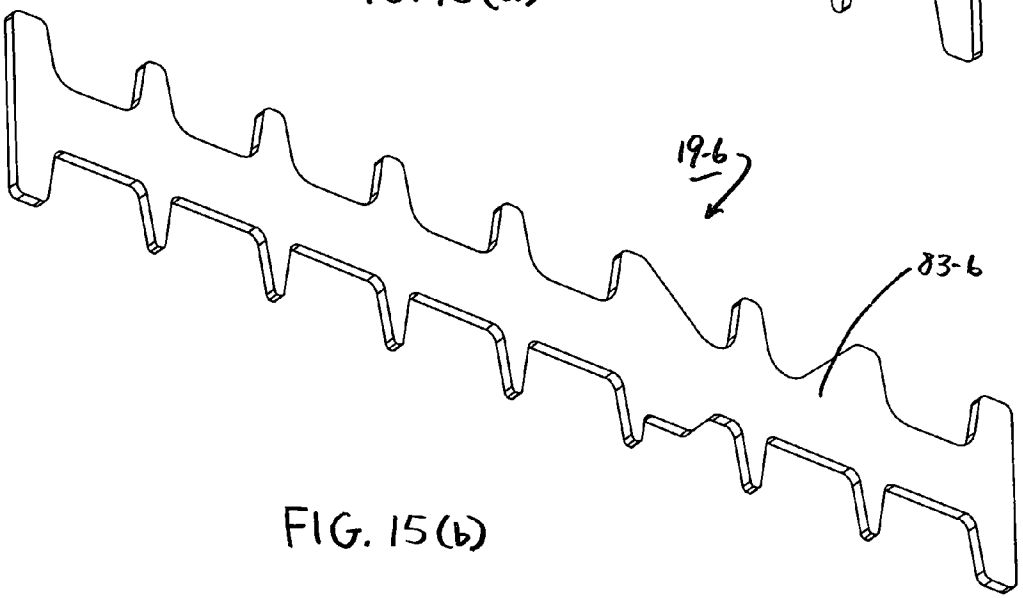
Figure 15C:
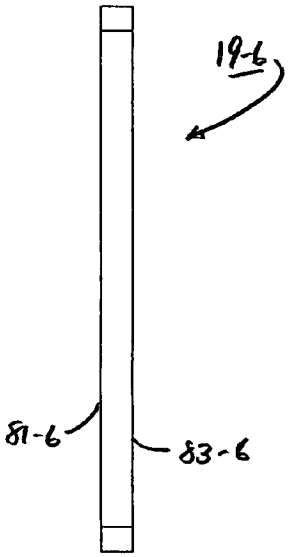

(*c*)), fifth slider 19-5 (which is shown in isolation in FIGS. 14(*a*)-(*c*)), and sixth slider 19-6 (which is shown in isolation in FIGS. 15(*a*)-(*c*)) are arranged front-to-back in a stacked formation. In turn, the stack of sliders 19 is fittingly disposed within the narrow recess 45 in housing 13, the thickness of sliders 19 being such that there is a limited amount of clearance with the stack in recess 45 (i.e., with spacing that is less than the width of a single slider 19).

Each slider 19 is constructed as a unitary member formed from an inexpensive insulating material, such as plastic, and includes a flattened front surface 81 and a flattened rear surface 83.

As a principal feature of the present invention, projections 85 are formed on alternating sliders 19 to limit the surface area contact between adjacent sliders 19 when arranged in stacked form within narrow recess 45. Specifically, projections 85 are preferably formed onto: (i) rear surface 83-1 of first slider 19-1 (as seen most clearly in FIGS. 10(*a*)-(*c*)), (ii) both front surface 83-3 and rear surface 85-3 of third slider 19-3 (as seen most clearly in FIGS. 12(*a*)-(*c*)), and (iii) both front surface 83-5 and rear surface 85-5 of fifth slider 19-5 (as seen most clearly in FIGS. 14(*a*)-(*c*)).

For illustration purposes only, the details relating to projections 85 will be discussed herein in connection with third slider 19-3. However, it is to be understood that each projection 85 formed on first slider 19-1 and fifth slider 19-5 is preferably similar in size, shape and location.

Referring now to FIGS. 12(*a*)-(*c*), third slider 19-3 is in the form of an elongated comb-like member that has an overall length L of approximately 3.9375 inches, an overall width W of approximately 0.6875 inches, and a thickness T of approximately 0.0625 inches. As can be seen, three projections 85 are formed onto both front surface 83-3 and rear surface 85-3 in a spaced apart relationship.

Each projection 85 is represented herein as being in the form of a post, or bump, that is generally circular in transverse cross-section with a diameter D of approximately 0.125 inches. As seen most clearly in FIG. 12(*c*), projections 85 extend orthogonally out from front and rear surfaces 83-3 and 83-5 a limited height H that is preferably in the range of approximately 0.001-0.004 inches. As a result, projections 85 serve to create adequate spacing between opposing surfaces of adjacent sliders 19 when arranged in stacked form, as seen most clearly in FIG. 9(*b*).

In use, sliders 19-1, 19-2, 19-3, 19-5 and 19-6 are designed for longitudinal displacement within recess 45. To the contrary, slider 19-4 functions solely as a stationary, or detent, slider that releasably retains certain depressed push rods 17, as will be described further below.

Each slider 19 has a unique top and bottom edge profile. When stacked together, the unique top and bottom edge profiles of each slider 19 allows for the regulation of the switching states of movable contacts 21 through the depression of push rods 17. For illustration purposes only, the details relating to the top and bottom edge profiles of third slider 19-3 will be discussed herein. However, it is to be understood that although each slider 19 has a unique profile, certain sliders 19 share common design features that function in a similar capacity.

As seen in FIGS. 12(*a*)-(*c*), third slider 19-3 comprises a top edge 87-3 and a bottom edge 89-3. Top edge 87-3 is shaped to include a plurality of raised peaks, or tips, 91 that are equidistantly spaced apart from one another. With push button switch 11 in its assembled form, each tip 91 is aligned to project between a corresponding adjacent pair of push rods 17.

Top edge 87-1 is additionally shaped to include a unique arrangement of inclined surfaces 93, with certain surfaces 93-1 extending at a 45 degree incline from left-to-right and certain surfaces 93-2 extending at a 45 degree incline from right-to-left. As will be described further below, each inclined surface 93 is aligned to interact with the innermost end of a corresponding push rod 17 to displace its slider 19 longitudinally within recess 45, the particular orientation of inclined surface 93 determining the direction slider 19 travels.

Bottom edge 89-3 is similarly shaped to include a plurality of narrow, downwardly protruding tines 95 that are equidistantly spaced apart from one another. With push button switch 11 in its assembled form, each tine 95 is aligned to project between a corresponding adjacent pair of movable contacts 21 and into direct contact against top surface 63-1 of PCB 63. In this manner, the abutment of tines 95 against PCB 63 prevents the downward displacement of sliders 19 upon engagement with a depressed push rod 17 (i.e., limits sliders 19 to horizontal, or longitudinal, displacement).

Bottom edge 89-3 is additionally shaped to include a unique arrangement of cam surfaces, or cams, 97 between tines 95, each raised cam surface 97 extending approximately one-half the width across adjacent tines 95. As will be described further below, each cam 97 is dimensioned to selectively engage and pivot cantilevered spring blade end 69 of selected movable contacts 21 from its closed position to its open position.

Figure 16:
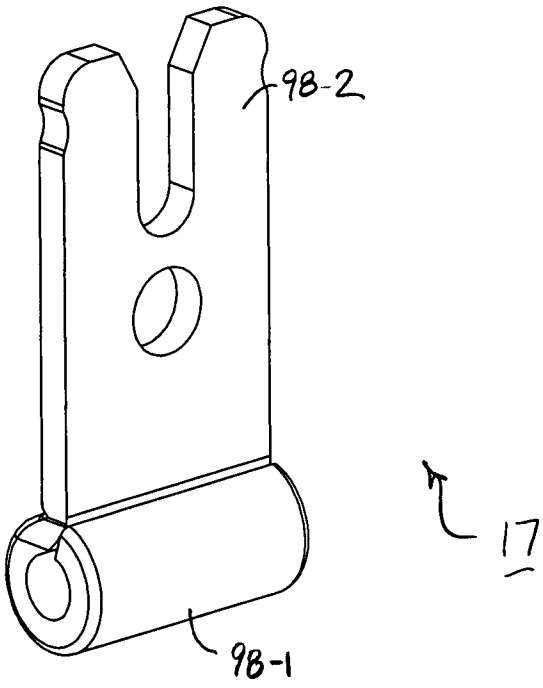
FIG. 16 is an enlarged, right end perspective view of one of the push rods shown in FIG. 3.

Referring now to FIGS. 3 and 16, each push rod 17 is formed as a unitary member that is constructed of a rigid and durable material, such as metal. Push rod 17 is represented herein is being in the form of an elongated blade that includes a rounded inner end 98-1 and a bifurcated outer end 98-2.

Figure 17A:
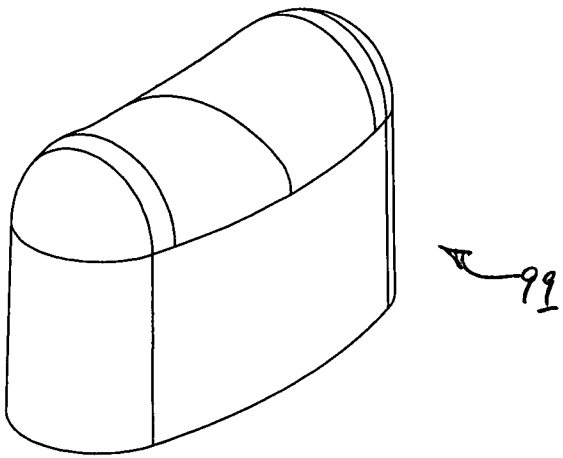
FIGS. 17(*a*) and 17(*b*) are top perspective and bottom perspective views, respectively, of one of the buttons shown in FIG. 3.
Figure 17B:
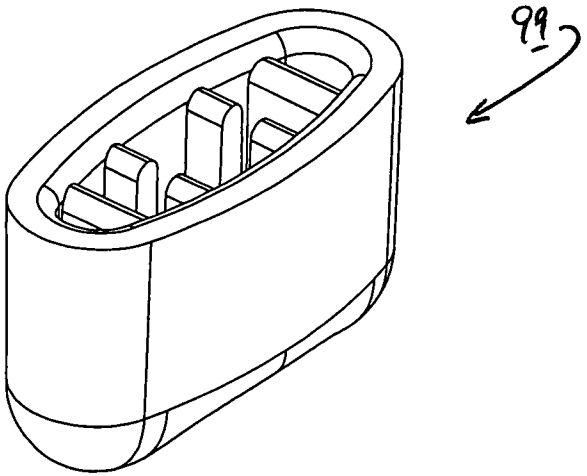

Each push rod 17 extends vertically through a corresponding slot 39 in housing 13 and fittingly aligns within a corresponding pair of notches 46 in inner walls 43-1 and 43-2, thereby limiting displacement of push rods 17 to a vertical plane. Inner end 98-1 of each push rod 17 is disposed within interior cavity 37 in proximity to top edge 87 of sliders 19. Outer ends 98-2 of push rods 17-1 thru 17-8 are externally located and are adapted to fixedly receive buttons 99-1 thru 99-8, respectively. Each button 99, one of which is shown in isolation in FIGS. 17(*a*) and 17(*b*), is a unitary member that is constructed of a rigid and durable material, such as plastic.

Accordingly, with push button switch 11 in its assembled form, sliders 19 are stacked front-to-back, as shown in FIGS. 9(*a*) and 9(*b*), and are retained within recess 45 in housing 13. In addition, PCB assembly 57 is secured to housing 13 by screws 64 so that tines 95 on sliders 19 project between cantilevered spring blade ends 69 of movable contacts 21 and into direct abutment against top surface 63-1 of PCB 63. In its naturally biased state, sliders 19 are arranged such that at least one cam surface 97 urges each movable contact 21 into its open position, thereby precluding the application of power to the load.

In use, the depression of each button 99 serves to drive its corresponding push rod 17 vertically downward. This downward displacement of each push rod 17 causes its rounded second end 17-1 to contact any inclined surfaces 93 in vertical alignment therewith. The application of pressure onto aligned inclined surfaces 93 by second end 17-1 of push rod 17 causes its corresponding sliders 19 to displace longitudinally within recess 45 until one or more cam surfaces 97 disengage from one or more corresponding movable contacts 21. With selected movable contacts 21 now closed, a unique application of current is applied to the load terminal.

Depression of additional buttons 99 serves to similarly displace sliders 19 within recess 45 to form the ten distinct switch settings. It should be noted that first slider 19-1 is spring biased to its original orientation and is therefore capable of being used, inter alia, to achieve momentary, or pulse, operations using push rod 17-1, which is the only push rod 17 that does not releasably engage detent slider 19-4 (pulse-type operations being obtained through the closure of contacts 21-1 and 21-8).

As noted above, the surface area contact maintained between adjacent sliders 19 is limited to circular bumps 85 even as sliders 19 are longitudinally displaced within recess. Stated another way, sliders 19 are designed to ride, or glide, on projections 85 during longitudinal displacement. As can be appreciated, this significant reduction in the surface area contact between sliders 19 minimizes the frictional forces experienced therebetween and thereby eliminates the needs for the use of lubricants or other similar friction reducing products, which is highly desirable.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

For example, it should be noted that other types of push-button switches that include a stack of sliders could be similarly modified to include raised projections 85 on selected slider surfaces to minimize the surface area contact between adjacent sliders and thereby reduce the frictional forces experienced therebetween during slider displacement.

As another example, it should be noted that the number, location and dimensions of projections 85 on sliders 19 could be modified without departing from the spirit of the present invention as long as the resultant surface area contact between adjacent sliders is substantially limited.

What is claimed is:

1. A push button switch for regulating the application of current from a power source to a load, the push button switch comprising:

(a) a hollowed housing, (b) an electric switching circuit coupled to the hollowed housing, the electric switching circuit comprising a movable contact for regulating the application of current from the power source to the load, and (c) first and second sliders, each of the first and second sliders including a front surface and a rear surface, the first and second sliders being arranged in a front-to-back stacked relationship and disposed within the housing, at least one of the first and second sliders being adapted for longitudinal displacement within the housing and into selective engagement with the movable contact, (d) wherein at least one of the first and second sliders includes one or more projections formed on at least one of its front and rear surfaces, the entire surface contact established between the first and second sliders being achieved through the one or more projections.

2. The push button switch of claim 1 wherein at least one projection is formed on each of the front and rear surfaces of at least one of the first and second sliders.

3. The push button switch of claim 1 wherein each projection on the at least one of the first and second sliders extends out from the at least one of its front and rear surfaces at a right angle relative thereto.

4. The push button switch of claim 3 wherein each projection on the at least one of the first and second sliders extends out from the at least one of its front and rear surfaces at a height in the range of approximately 0.001 inches to 0.004 inches.

5. The push button switch of claim 1 wherein each projection is circular in transverse cross-section.

6. The push button switch of claim 5 wherein each projection is approximately 0.125 inches in diameter.

7. The push button switch of claim 1 further comprising a third slider, a fourth slider, a fifth slider and a sixth slider, each of the third, fourth, fifth and sixth sliders including a front surface and a rear surface.

8. The push button switch of claim 7 wherein the first, second, third, fourth, fifth and sixth sliders are arranged front-to-back in a stacked relationship within the narrow recess in the housing.

9. The push button switch of claim 8 wherein projections are formed on at least some of the first, second, third, fourth, fifth and sixth sliders, the entire surface contact established between the plurality of sliders being achieved through the projections.

10. The push button switch of claim 9 wherein projections are formed on alternating sliders in the stack.

11. The push button switch of claim 10 wherein projections are formed on the rear surface of the first slider, the front and rear surfaces of the third slider and the front and rear surfaces of the fifth slider.

12. The push button switch of claim 1 wherein the electric switching circuit comprises a printed circuit board assembly and a pair of conductive bus plates.

13. The push button switch of claim 12 wherein the printed circuit board assembly comprises:

(a) a printed circuit board (PCB) having a top surface and a bottom surface, and (b) a triode for alternating current (TRIAC) that is surface mounted on the top surface of the PCB using a conductive adhesive mixture of glue and solder paste.

14. The push button switch of claim 1 wherein the housing includes a top wall, a bottom wall, a front wall, a rear wall, a left end wall, and a right end wall that together define an interior cavity.

15. The push button switch of claim 14 wherein the housing additionally includes a pair of parallel inner walls extending longitudinally within the interior cavity, the pair of inner walls together defining a narrow recess that is dimensioned to receive the first and second stacked sliders.

16. The push button switch of claim 15 further comprising a plurality of push rods coupled to the hollowed housing for selectively engaging and displacing at least one of the first and second sliders in order to regulate the switching state of the movable contact.

17. The push button switch of claim 16 wherein each push rod includes a first end located within the housing and a second end located outside the housing.

18. The push button switch of claim 17 wherein the housing is shaped to include a plurality of slots, the second end of each push rod extending through a corresponding slot in the housing.

19. The push button switch of claim 18 wherein a button is fixedly mounted on the second end of each push rod.

* * * * *